United States Patent [19]

Appleton

[11] Patent Number: 4,914,262

[45] Date of Patent: Apr. 3, 1990

[54] QUICK DISCONNECT SWITCH

[76] Inventor: Arthur I. Appleton, 22 Indian Creek Island, Miami Beach, Fla. 33154

[21] Appl. No.: 199,941

[22] Filed: May 27, 1988

[51] Int. Cl.[4] ..... H01H 19/56; H01H 21/76; H01H 1/60

[52] U.S. Cl. ..... 200/8 R; 200/25; 200/242; 200/273

[58] Field of Search ..... 200/8 R, 8 A, 11 R, 200/11 G, 11 K, 16 R, 24, 26, 154, 155 R, 248, 250, 273, 274, 293, 558, 570, 571, 240–242, 253, 560

[56] References Cited

U.S. PATENT DOCUMENTS

| | | | |
|---|---|---|---|
| 421,179 | 2/1890 | Little | 200/274 X |
| 550,411 | 11/1895 | Harper | 200/163 |
| 1,005,521 | 10/1911 | Doughty et al. | 200/2 |
| 1,190,359 | 7/1916 | Zigler et al. | 200/273 |
| 1,894,543 | 1/1933 | Rowe | 200/151 |
| 2,231,576 | 2/1941 | Grosse | 200/149 A |
| 2,254,347 | 9/1941 | Blakesley | 200/165 |
| 2,363,295 | 11/1944 | Cotter | 200/163 |
| 2,477,837 | 8/1949 | Strom | 200/150 R |
| 3,046,366 | 7/1962 | Zekendorf | 200/155 R X |
| 3,257,534 | 6/1966 | Kessdring et al. | 200/151 R |
| 3,297,848 | 1/1967 | Ricard et al. | 200/150 B |
| 3,471,658 | 10/1969 | Elliott | 200/8 R |
| 3,860,321 | 11/1975 | Ball | 439/185 |
| 4,015,112 | 3/1977 | Castaldo | 200/155 R X |
| 4,260,863 | 4/1981 | Appleton | 200/144 R |
| 4,399,336 | 8/1983 | Greve | 200/11 R |
| 4,620,061 | 10/1986 | Appleton | 174/51 |

*Primary Examiner*—J. R. Scott

*Attorney, Agent, or Firm*—Jones, Day, Reavis & Pogue

[57] ABSTRACT

A pivotable shaft supports a plurality of conductor elements. The conductor elements are pivoted into and out of contact with their associated electrical contacts upon rotation of an over center mechanism so as to selectively make or break an electrical connection. The conductor elements are freely rotatable within the shaft so as to minimize the effects of arcing on these members. The pivotable shaft is supported in a housing made of non-conductive material such that the electrical contacts and conductor elements are isolated from the surrounding environment to provide an explosion proof switch.

6 Claims, 3 Drawing Sheets

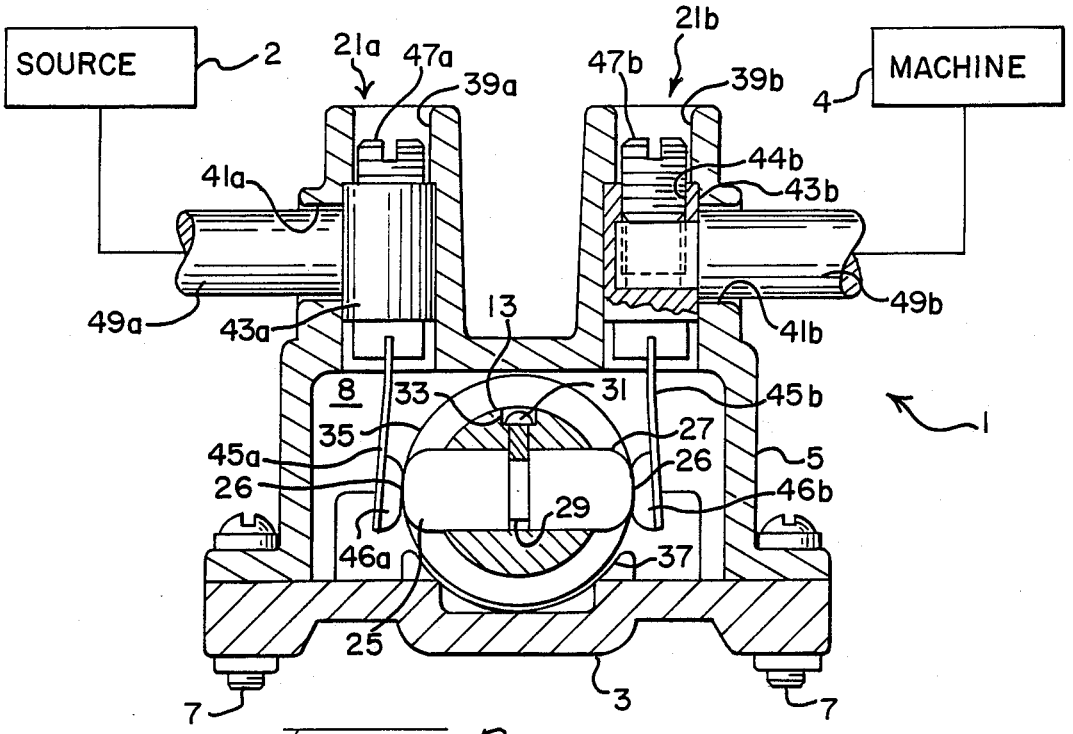
FIG-2
FIG-3
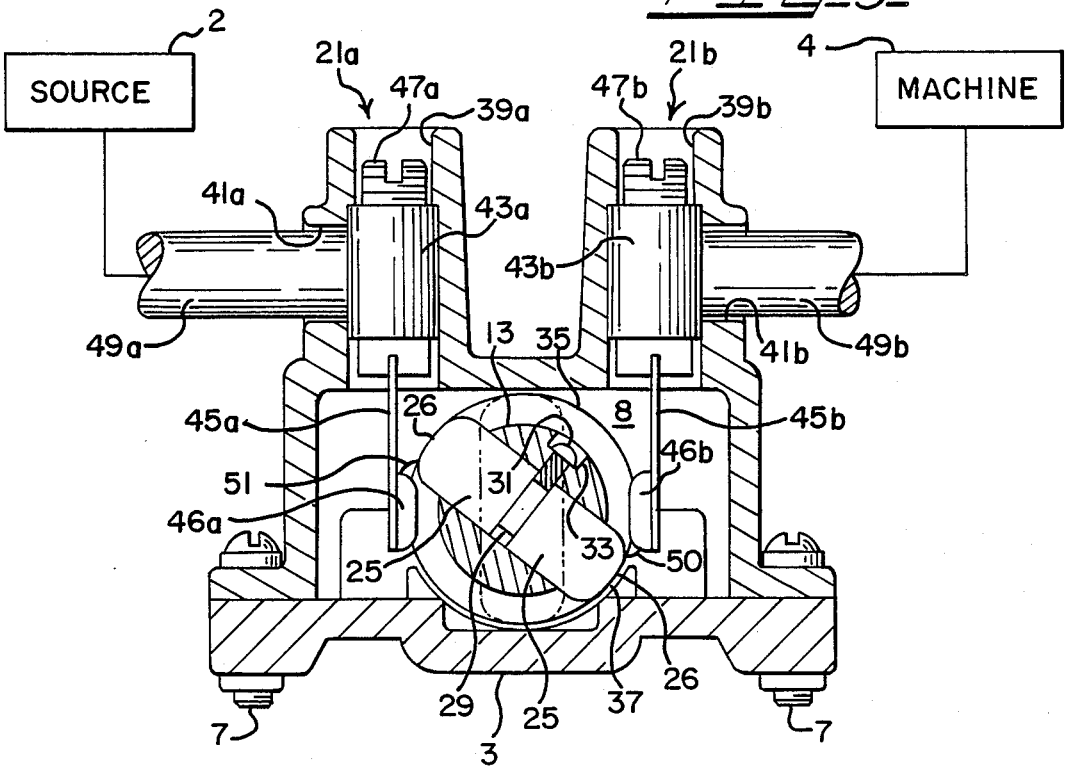

QUICK DISCONNECT SWITCH

BACKGROUND OF THE INVENTION

The invention relates, generally, to electrical circuits for powering electrical equipment in industrial applications and, more particularly, to a quick disconnect switch for breaking the connection between the electrical power source and the electrical equipment.

Frequently, in industrial systems having an electrical power source connected to electrical equipment, it is necessary to perform maintenance or repair work on the electrical equipment. In order to perform this maintenance and repair work with a maximum degree of safety, the electrical connection between the power source and the equipment must be broken. In an attempt to facilitate this operation, numerous prior art switches and connectors have been developed. Typically, these switches consist of a first set of terminals connected to the electrical power source through conductive cables, a second set of terminals connected to the electrical equipment through additional electrical cables, and a sliding or rotating conductive member for selectively connecting or disconnecting the first set of terminals and the second set of terminals to thereby break or make the electrical circuit.

One shortcoming of the known switches is their susceptibility to the effects of arcing. As is well-known in the art, an arcing phenomenon occurs between the conductive member and the terminals as the gap between the conductive member and terminals narrows during opening and closing of the switch. This arcing phenomenon causes scarring on the affected surfaces such that over time the scarred connector's ability to conduct current is impaired. The electrical arc is also capable of igniting dust particles, etc, thereby causing an explosion.

A second shortcoming of the known switches is the need for a separate enclosure to isolate the switch from the surrounding environment in the event that the arcing at the switch causes an explosion. One such enclosure is disclosed in U.S. Pat. No. 4,620,061. The present invention eliminates the need for a separate explosion proof enclosure because the contact elements of the switch are located within an explosion proof housing that is designed as part of the switch.

Switches used in this capacity must have a high degree of reliability because the potential for harm from a faulty switch is great. Moreover, the switches must be dependable so as to be able to perform reliably over an extended period of time. The switch should be simple and inexpensive to manufacture and install so as to make its use practicable. The switches must also minimize arcing and the effects thereof such as scarring of the electrical contacts and risk of explosion. Moreover, the apparatus used to break the connection should operate as quickly and easily as possible to minimize the idle time of the equipment.

BRIEF DESCRIPTION OF THE INVENTION

The quick disconnect switch of the invention is of a simple economical design that is both reliable and dependable and includes a pivotable shaft supporting a plurality of conductor elements. The conductor elements are pivoted into and out of contact with their associated electrical contacts upon rotation of the shaft so as to selectively make or break the electrical circuit. The conductor elements are freely rotatable within the shaft so as to minimize the effects of arcing on these members. A housing made of non-conductive material supports the conductor elements and isolates the switch from the human operator and the surrounding environment to provide an explosion proof enclosure formed as an integral part of the switch.

OBJECTS OF THE INVENTION

It is a general object of the invention to provide an improved quick disconnect switch for an electrical circuit.

It is another object of the invention to provide an improved disconnect switch which minimizes the effects of arcing.

It is yet another object of the invention to provide an improved disconnect switch having a simple and economical construction.

It is a further object of the invention to provide an improved disconnect switch that exhibits a high degree of reliability and dependability.

It is still a further object of the invention to provide an explosion proof disconnect switch.

Other objects of the invention, in addition to those set forth above, will become apparent to one of ordinary skill in the art from the following detailed description.

BRIEF DESCRIPTION OF THE DRAWINGS

FIG. 2 shows a sectional view taken through a terminal pair of the switch shown in FIG. 1;

FIG. 3 shows a sectional view similar to that of FIG. 2 with the electrical connection broken.

DETAILED DESCRIPTION OF THE INVENTION

Figure 1:
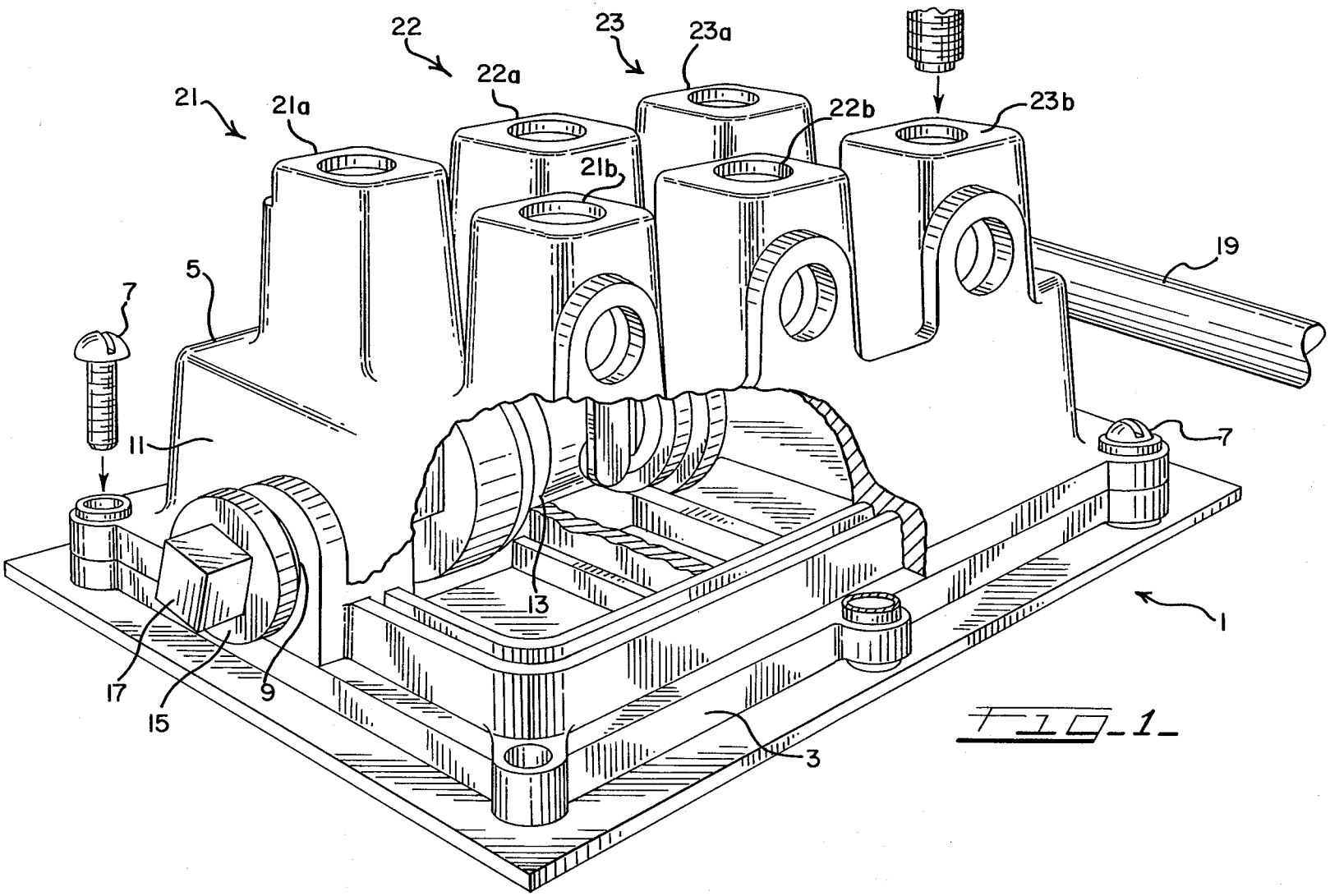
FIG. 1 shows a partially cut-away perspective view of the disconnect switch of the invention.

The quick disconnect switch 1 of the invention is shown in FIGS. 1 and 2 connecting an electrical power source 2 with a piece of electrical equipment 4 and consists of a lower housing portion 3 and an upper housing portion 5 secured together by bolts 7 to create an enclosed chamber 8 in which the switch is located. The upper housing portion 5 includes a first bearing 9 located in sidewall 11 and a second identical bearing (not shown) located in the opposite sidewall. The ends of a shaft 13 are rotatably supported in the bearings such that the shaft 13 is able to rotate, along its longitudinal axis. One end of the shaft, formed with screw threads (not shown), extends beyond the housing sidewall 11 and is engaged by a washer 15 and nut 17, as shown in FIG. 1. The other end of shaft 13 extends beyond the opposite housing sidewall and is secured to handle 19. Handle 19 is of a well-known spring-loaded over-center design, for example, which, upon manual actuation of the handle, virtually instantaneously rotates the shaft 13 from the connected position of FIG. 2 to the disconnected position of FIG. 3. The switch illustrated in FIGS. 1 and 2 is specifically designed for use with three-phase electrical current, having three sets of terminal pairs 21, 22, and 23, each terminal pair consisting of an infeed terminal **21*a*, 22*a*, and 23*a* and an outfeed terminal 21*b*, 22*b*, and 23*b***, respectively. The specific construction of the terminals will be hereinafter described. Of course, other configurations of the switch will be evident to one of ordinary skill in the art depending upon the particular circuitry of the electrical system employed.

Shaft 13 is formed of a non-conductive material and has a plurality of through holes located therein where the number of through holes is equal to the number of terminal pairs. In the preferred embodiment there are three such through holes. Each through hole receives a conductor element 25 having a substantially cylindrical shape with rounded edges 27 and a centrally located circumferentially extending groove 29. The conductor element 25 is dimensioned such that it is slidably received within the through hole and extends beyond the periphery of the shaft 13. A pin or set screw 31 is located in an aperture 33 disposed perpendicularly to the longitudinal axis of the through hole such that the pin 31 engages the groove 29. The pin 31 restricts longitudinal movement of the conductor element 25 within the through hole but allows the conductor element to rotate along its longitudinal axis, the purpose of which will be hereinafter described. The shaft 13 is also formed with larger diameter portions 35 which cooperate with arcuate recesses 37 formed in the lower housing portion 3 to provide added support for the shaft.

Associated with each conductor element 25 is one of the terminal pairs 21–23, All of the terminal pairs are identical therefore description will be made only with reference to terminal pair 21. Terminal pair 21 consists of two identical terminals **21*a* and 21*b*. Terminals 21*a* and 21*b* each consist of a first bore 39*a* and 39*b*, respectively, that connects the interior chamber 8 of the switch with the surrounding environment. A second bore 41*a* and 41*b* intersects each of the first bore 39*a* and 39*b* to form substantially T-shape passages. Conductive sleeves, 43*a* and 43*b*, having L-shape orifices 44*a* (only one of which is shown), are disposed within the passages to connect the first bores 39*a* and 39*b* with the second bore 41*a* and 41*b*, respectively, such that the interior of the chamber 8 is isolated from the surrounding environment. Projecting from the conductive sleeves 43*a* and 43*b* are flexible contacts 45*a* and 45*b* having end portions 46*a* and 46*b* which extend into the chamber 8 to a position adjacent the conductor element 25. Set screws 47*a* and 47*b* threadably engage screwthreads (not shown) formed on the conductive sleeves 43*a* and 43*b*. Electrically conductive cables 49*a* and 49*b* are inserted through each of the second bores 41*a* and 41*b* and into the sleeves 43*a* and 43*b* such that they make contact with the conductive material of the sleeves 43. The set screws 47*a* and 47*b* are tightly screwed into engagement with the sleeves 43*a* and 43*b* to securely trap the cable within the sleeve and maintain the electrical connection. Thus, an electrically conductive path is completed from the electrical equipment 4 to the flexible contact 45*b* through the cable 49*b* and conductive sleeve 43*b*. The identical arrangement completes the electrical path from the power source 2 through cable 49*a* to the flexible contact 45*a* of the other terminal 21*a* as shown in FIG. 2**.

The flexible contacts **45*a* and 45*b* can be selectively connected and disconnected to one another by the rotating conductor element 25 to thereby make or break the connection between the electrical power source 2 and the electrical equipment 4. Normally the rotating shaft 13 will be in the position shown in FIG. 2 where the electrical power is supplied from the power source to the electrical equipment through the cable 49*a*, the first terminal 21*a*, the conductor element 25, the second terminal 21*b*, and the cable 49*b*. The flexible contacts 45*a* and 45*b*, because of their natural resiliency, are biased into engagement with the conductor element 25** to thereby maintain contact between the terminal pairs and the conductor elements.

If it is necessary to break the electrical connection between the power source 2 and the electrical equipment 4, for example to repair the equipment, the handle 19 is rotated manually. Rotation of the handle 19 causes the over-center spring loaded mechanism to abruptly rotate the shaft 13 to the disconnected position shown in dotted line in FIG. 2. When the shaft 13 rotates, the conductor element 25 is instantaneously rotated out of engagement with the flexible contacts **45*a* and 45*b* such that the electrical connection is broken. Correspondingly, a counter-rotation of the handle 19 will cause the shaft 13, and, therefore the conductor element 25, to rotate back into engagement with the flexible contacts 45*a* and 45*b* to complete the electrical circuit. While the abrupt pivoting motion of the shaft caused by the spring loaded handle minimizes the arcing between the flexible contacts and the conductor element, some arcing will occur due to the high voltage and current used in the typical industrial setting. The lines 50 and 51 in FIG. 3** represent the arcing between the conductor element and the flexible contacts of the terminals as the shaft is rotated to and from the disconnected position.

As is well known to one of ordinary skill in the art, this arcing phenomena causes scarring on the areas of the flexible contacts and conductive elements where the arcing occurs. In the known devices the arcing occurs repeatedly on the same points of the conductive elements. As a result, the scarring due to this arcing will build up over a period of time and will eventually have a deleterious effect on the performance of the contacts.

The design of the switch of the present invention substantially reduces the effects of scarring as will presently be explained. I have discovered that the conductive element of the present invention is rotated an incremental amount along its longitudinal axis upon each opening and closing of the switch. The interengagement of the pin 31 and the groove 29 on the conductive element 25 of the preferred embodiment allows this rotating movement to occur. As a result of this incremental rotation, the arcing does not occur at the same point on the conductive member 25. Rather, the scarring due to the arcing is distributed over the rounded edge portions 27 of the exposed surface of the conductive element. Thus, the scarred area is not concentrated at one point on the contact member, as is the case with the prior art devices, whereby the adverse effects on the electrical connection are minimized. Moreover, in the position illustrated in FIG. 2 the electrical contact is made between the flexible contacts **45*a* and 45*b* and the clean central portion 26 of the conductive element 25**.

Figure 4:
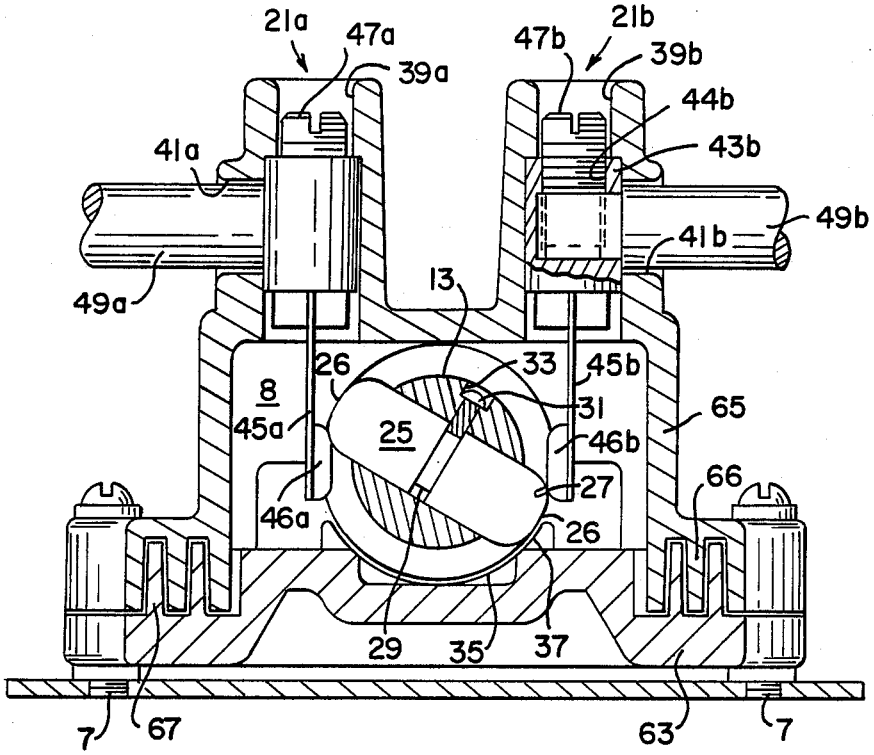
FIG. 4 shows a sectional view similar to that of FIG. 2 of a second embodiment of the invention.

As is evident from the detailed description, all of the components of the switch of the invention are located within the chamber 8 of the housing and are therefor isolated from the external environment. This design minimizes the damage that could result from an explosion caused by the arcing during a disconnect operation. In order to provide an added degree of safety the housing shown in FIG. 4 has been developed. The construction of the switch is identical to that of the preferred embodiment. However, the housing has been slightly modified such that the upper housing portion 65 and the lower housing portion 63 are provided with interdigitating flanges 66 and 67, respectively. The flanges 66 and 67 extend for the entire periphery of the upper and lower housing portions such that if an explosion were to occur the housing portions would resist separating from one another. Thus, the effects of the explosion would be isolated from the surrounding environment.

Although the invention has been described in its preferred form with a certain degree of particularity, it is understood that the present disclosure has been made by way of example only. Numerous changes in the details and construction of the combination and arrangement of parts will be apparent without departing from the spirit and scope of the invention.

What is claimed is:

1. A quick disconnect switch for an electrical circuit, comprising:

a rotating member pivotable between a first position and a second position;

means for supporting said rotating member;

at least one conductor element mounted in said rotating member such that it is free to rotate relative to said rotating member;

a pair of terminals associated with each of said at least one conductor element including a first terminal having a contact member associated therewith and a second terminal having a contact member associated therewith wherein said contact member contact said conductor element when said rotating member is in said first position to thereby make an electrical connection therebetween and said contact members are separated from said conductor element when said rotating member is in said second position to thereby break said electrical connection, said conductor element rotating incrementally independently of the pivoting of said rotating member upon movement of the rotating member between said first and second positions; and means for supporting said terminals.

2. A quick disconnect switch according to claim 1, wherein said rotating member is made of non-conductive material.

3. A quick disconnect switch according to claim 1, wherein said conductor element is located in a bore formed in the rotating member and is dimensioned such that it extends beyond the periphery of said rotating member and is slidable therein, a circumferentially disposed groove formed in the conductor element and engaged by a pin such that the conductor element is prevented from longitudinal movement within said bore while being free to rotate therein.

4. A quick disconnect switch according to claim 1, wherein of said contact members are flexible contacts extending from a conductive sleeve.

5. A quick disconnect switch according to claim 1, wherein there are three of said conductive members.

6. A quick disconnect switch according to claim 1, wherein said rotating member is supported by and located within an explosion proof housing.

* * * * *